US009470991B2

(12) United States Patent
Katayama et al.

(10) Patent No.: US 9,470,991 B2
(45) Date of Patent: Oct. 18, 2016

(54) METHOD FOR PRODUCING POSITIVELY CHARGEABLE TONER

(71) Applicant: Kao Corporation, Chuo-ku (JP)

(72) Inventors: Kohei Katayama, Wakayama (JP); Masahito Yamazaki, Wakayama (JP)

(73) Assignee: Kao Corporation, Chuo-ku (JP)

( * ) Notice: Subject to any disclaimer, the term of this patent is extended or adjusted under 35 U.S.C. 154(b) by 0 days.

(21) Appl. No.: 14/506,762

(22) Filed: Oct. 6, 2014

(65) Prior Publication Data

US 2015/0111143 A1 Apr. 23, 2015

(30) Foreign Application Priority Data

Oct. 18, 2013 (JP) ..... 2013-217310
Aug. 6, 2014 (JP) ..... 2014-160380

(51) Int. Cl.
*G03G 9/08* (2006.01)
*G03G 9/087* (2006.01)

(52) U.S. Cl.
CPC ..... *G03G 9/081* (2013.01); *G03G 9/0817* (2013.01); *G03G 9/0872* (2013.01); *G03G 9/08755* (2013.01)

(58) Field of Classification Search
CPC ..... G03G 9/081; G03G 9/08755; G03G 9/0872; G03G 9/0817
USPC ..... 430/108.11, 124.1, 137.18
See application file for complete search history.

(56) References Cited

U.S. PATENT DOCUMENTS 5,846,683 A * 12/1998 Murakami ..... G03G 9/081 430/137.21
2003/0037893 A1* 2/2003 Simula ..... D21H 11/22 162/158
2008/0107987 A1 5/2008 Fukushima et al.
2010/0136469 A1* 6/2010 Tajima ..... G03G 9/08755 430/108.2

FOREIGN PATENT DOCUMENTS

| | | | | |
|---|---|---|---|---|
| JP | 2002-107995 | * | 4/2002 | ..... G03G 9/08 |
| JP | 2004-286820 | | 10/2004 | |
| JP | 2008-139611 | | 6/2008 | |
| JP | 2008-139851 | | 6/2008 | |
| JP | 2010-152225 | | 7/2010 | |
| JP | 2010-152234 | | 7/2010 | |
| JP | 2010-249938 | | 11/2010 | |

OTHER PUBLICATIONS

Machine translation of JP2002-107995, pp. 1-7.*

* cited by examiner

*Primary Examiner* — Thorl Chea
(74) *Attorney, Agent, or Firm* — Oblon, McClelland, Maier & Neustadt, L.L.P.

(57) ABSTRACT

A method for producing a positively chargeable toner, including: step 1: melt-kneading a toner raw material composition containing a resin binder, a positively chargeable charge control agent, and fine fluororesin particles, and a recycled powder; step 2: cooling a melt-kneaded mixture obtained in the step 1, and pulverizing a cooled mixture; and step 3: classifying a pulverized product obtained in the step 2, wherein the resin binder in the toner raw material composition contains 50% by mass or more of a polyester having a softening point of 125° C. or higher and 170° C. or lower. The positively chargeable toner obtainable by the method of the present invention is suitably used in developing latent images formed in, for example, an electrophotographic method, an electrostatic recording method, an electrostatic printing method, or the like.

18 Claims, 1 Drawing Sheet

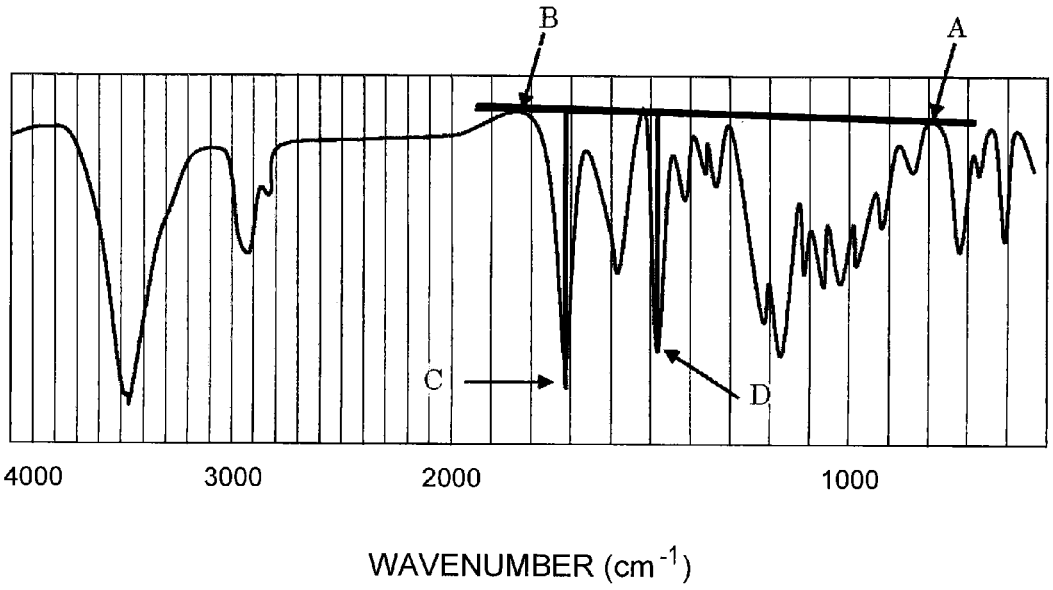
B
A
C
D
4000
3000
2000
1000
WAVENUMBER (cm-1)

METHOD FOR PRODUCING POSITIVELY CHARGEABLE TONER

FIELD OF THE INVENTION

The present invention relates to a method for producing a positively chargeable toner usable in developing latent images formed in, for example, an electrophotographic method, an electrostatic recording method, an electrostatic printing method, or the like, a positively chargeable toner obtainable by the method, and a method for forming fused images using the toner.

BACKGROUND OF THE INVENTION

With the demands of speeding up and high-quality images of copy machines and laser printers of the recent years, toners are required to have smearing resistance, durability, triboelectric stability, and the like. In addition, with the expansion of the markets, a toner capable of forming high-quality, high-efficiency images against diversified media, further against sheets with diversified grades in a case of paper.

Patent Publication 1 (Japanese Patent Laid-Open No. 2010-152234) discloses a method for forming fused images including the step of after-treating a recording medium to which a toner is fused by heat-and-pressure fusing with a post-treatment machine, thereby forming fused images at a printing speed of 45 m/min or more, wherein the toner comprising toner matrix particles and an external additive, the toner matrix particles containing a resin binder, a colorant, and a specified amount of fluororesin powders having an average particle size of from 0.1 to 1 μm, is used, whereby smearing resistance is excellent and a high-quality image can be maintained even when printing is continued for a long period of time.

Patent Publication 2 (Japanese Patent Laid-Open No. 2010-152225) discloses as a toner having excellent triboelectric stability, transferability, low-temperature fusing ability, and smearing property, a toner containing a resin binder comprising a linear polyester, the linear polyester containing a polyester having a softening point of from 90° to 115° C., obtainable by polycondensing at least a carboxylic acid component comprising an aromatic carboxylic acid compound, and an alcohol component, wherein the toner has a specified particle size distribution, and contains fine fluororesin particles having an average particle size of 1 μm or less in a specified amount.

In addition, Patent Publication 3 (Japanese Patent Laid-Open No. 2008-139851 (corresponding to U.S. Patent Application Publication No. 2008/0107987)) describes a toner comprising toner matrix particles containing at least a resin binder and a colorant, and an external additive coating thereto, wherein the toner in which the above-mentioned toner matrix particles contain fine fluororesin particles having an average particle size of 1 μm or less in a specified amount maintains excellent fused images even in long-term durability printing at a low coverage ratio, so that the toner has excellent fusing ability.

Further, Patent Publication 4 (Japanese Patent Laid-Open No. 2004-286820) discloses a toner for electrostatic image development obtained by dissolving or dispersing at least a prepolymer made of a modified polyester-based resin, a compound capable of extending or crosslinking with the prepolymer, and a colorant in an organic solvent to allow a crosslinking reaction and/or an extension reaction in an aqueous medium, and removing the solvent from the dispersion obtained, characterized in that the toner contains fine fluororesin particles, in which the toner for electrostatic image development meets the needs of a low-temperature fusing system, while maintaining cleanability, has excellent offset resistance, and has a sharp triboelectric charge distribution without soiling fusing apparatuses and fused images, whereby excellently vivid and sharp, visible fused images can be formed over a long period of time.

Moreover, Patent Publication 5 (Japanese Patent Laid-Open No. 2008-139611) discloses, as a method of obtaining a toner having stable properties in triboelectric properties and fluidity even by a long-term use without generating filming to a photoconductor, a method for producing a toner characterized in that the method includes the steps of kneading an internal additive including a releasing agent and a resin binder, pulverizing a kneaded mixture, adding at least a part of an external additive to a pulverized powder, classifying the mixture powder, and recycling a fine powder component outside a given particle size obtained by the above classifying step back to the kneading step, wherein the internally added amount of the above-mentioned external additive contained in the internal part of the above-mentioned toner particles is within a specified range based on the amount of the toner components, excluding the amount of the external additives.

SUMMARY OF THE INVENTION

The present invention relates to:

[1] a method for producing a positively chargeable toner, including:

step 1: melt-kneading a toner raw material composition containing a resin binder, a positively chargeable charge control agent, and fine fluororesin particles, and a recycled powder;

step 2: cooling a melt-kneaded mixture obtained in the step 1, and pulverizing a cooled mixture; and step 3: classifying a pulverized product obtained in the step 2, wherein the recycled powder is a powder removed in the step 3, wherein the amount of the recycled powder melt-kneaded with the toner raw material composition in the step 1 is 1.5 parts by mass or more, based on 100 parts by mass of the resin binder in the toner raw material composition, and wherein the resin binder in the toner raw material composition contains 50% by mass or more of a polyester having a softening point of 125° C. or higher and 170° C. or lower, and wherein the content of the fine fluororesin particles in the toner raw material composition in the step 1 is 0.3 parts by mass or more and 4.5 parts by mass or less, based on 100 parts by mass of the resin binder in the toner raw material composition;

[2] a positively chargeable toner obtainable by the method as defined in the above [1]; and

[3] a method for forming fused images, including charging a photoconductor;

exposing the photoconductor;

developing including adhering a positively chargeable toner as defined in the above [2] to an electrostatic latent image formed on the photoconductor to form a visible image;

transferring a formed visible image to a printout sheet; and fusing a transferred visible image to the printout sheet, wherein the printout sheet has a Bekk smoothness of 60 S or less.

BRIEF DESCRIPTION OF THE DRAWINGS

FIG. 1 is one example of FT-IR spectrum of a mixture of a toner and paper powders.

DETAILED DESCRIPTION OF THE INVENTION

When papers with relatively lower in quality, which are often found in all-purpose papers and the like are used for printing, conventionally adhesion to a photoconductor may be generated even with a toner less likely to cause toner filming to a photoconductor, thereby causing imaging failures. As a result of analyzing the adhered substances, it is found that paper powders, not the toner, are a main component. In other words, recommended papers such as high-quality papers that manufacturers of printers and copy machines generally recommend retain a sufficient paper surface strength durable against stress in the electrophotographic process. On the other hand, all-purpose papers other than the recommended papers such as high-quality papers may, for example, have a large content of deinked pulps, i.e. waste papers, or have insufficient effects of paper strengthening agents and surface-coating agents, so that cases where surface strength of the papers is low are found in many cases, whereby it is assumed that paper powders are more likely to be generated due to stress applied to papers during printing.

Therefore, the present invention relates to a method for producing a positively chargeable toner which not only inhibits the generation of the adhesion on a photoconductor with paper powders even in cases where papers of lowered qualities are used, but also has excellent smearing resistance, a positively chargeable toner obtainable by the method, and a method for forming fused images using the toner.

The positively chargeable toner obtainable by the method of the present invention inhibits the generation of adhesion on a photoconductor with paper powders even in cases where papers of lowered qualities are used, and at the same time has excellent smearing resistance.

The present invention is a method for producing a positively chargeable toner, including melt-kneading a toner raw material composition containing a resin binder, a positively chargeable charge control agent, and fine fluororesin particles, and a recycled powder, pulverizing a kneaded mixture, and classifying a pulverized mixture, and the method has a great feature in the aspect of the use of a recycled powder containing fine fluororesin particles. According to the method of the present invention, a toner having inhibition of soiling of adhesion of paper powders to a photoconductor and excellent smearing resistance can be obtained in high productivity.

Although the reasons why the effects as mentioned are exhibited are not certain, they are considered as follows.

The soiling of a photoconductor, i.e. photoconductor filming, which has been conventionally known, is generated in a cleaning section for cleaning toners remaining non-transferred from a photoconductor with a wax or a crystalline polyester resin, which is a low-viscosity component in the toner, and silica used as an external additive of a toner as starting points.

On the other hand, in cases where papers with relatively lower in quality found in many cases in all-purpose papers are used in printing, adhesion on a photoconductor is generated even when a toner which is conventionally less likely to generate toner filming is used, which may cause imaging failures in some cases. As a result of analyzing the adhesion, it is found that the main component is paper powders, not the toner. This is considered to be due to the fact that paper powders generated in the step of transferring a toner to paper sheets are more likely to adhere to a photoconductor. Especially in a case of a method of transferring a toner including charging paper sheets in a reverse polarity to a toner with corona discharge or the like, paper powders are more likely to adhere to a photoconductor. In cases of positively chargeable toners, paper powders are negatively charged, and the photoconductor surface is positively charged, so that it is considered that the paper powders adhere electrostatically to a photoconductor.

In the positively chargeable toner obtainable by the method of the present invention, a toner and paper powders are triboelectrically charged by dispersing fine fluororesin particles in a toner to allow the fine fluororesin particles to be appropriately present on a toner surface, so that the triboelectric chargeability of the negatively charged paper powders by corona discharge or the like can be weakened, whereby consequently it is considered that electrostatic adhesive strength between a photoconductor and paper powders can be weakened, to prevent adhesion of the paper powders to a photoconductor can be prevented. Here, in cases where dispersibility of the fine fluororesin particles in a toner is worsened, and the fine fluororesin particles are excessively exposed to a toner surface, it is considered that electrostatic agglomeration takes place between fine fluororesin particles and paper powders, thereby weakening the effects of inhibiting adhesion on a photoconductor. By contrast, in the present invention, an appropriate share is applied during melt-kneading by including a polyester having a high softening point as a main component of a resin binder, whereby dispersibility of the fine fluororesin particles can be improved. Further, from the viewpoint that toner particles are those in which dispersibility of the fine fluororesin particles is previously increased, a recycled powder during the classifying step can be reused, so that the melt-kneading step can be efficiently carried out without being excessively extended, whereby a toner in which the fine fluororesin particles are inhibited from being excessively exposed to a toner surface can be obtained with high productivity. Accordingly, it is considered that the electrostatic agglomeration of the exposed fine fluororesin particles and paper powders is inhibited, so that adhesion of the paper powders to a photoconductor can be inhibited.

In addition, since the fine fluororesin particles have low frictional resistance, the fine fluororesin particles are homogeneously dispersed in the toner, so that the fine fluororesin particles are allowed to be present on the surface of the visible image after fusing, whereby frictional resistance of the visible images can be reduced. Consequently, it is assumed that smearing resistance (rubbing-fusing ability) is improved.

[Resin Binder]

It is preferable that the resin binder usable in the present invention contains a polyester having a high softening point as a main component, from the viewpoint of improving dispersibility of the fine fluororesin particles in the toner, thereby inhibiting soiling of a photoconductor derived from paper powders, and from the viewpoint of improving smearing resistance of the toner.

The polyester used in the present invention is obtained by polycondensing an alcohol component containing a dihydric or higher polyhydric alcohol, and a carboxylic acid component containing a dicarboxylic or higher polycarboxylic acid compound.

The dihydric alcohol includes diols having 2 or more carbon atoms and 20 or less carbon atoms, and preferably 2 or more carbon atoms and 15 or less carbon atoms; and alkylene oxide adducts of bisphenol A represented by the formula (I):

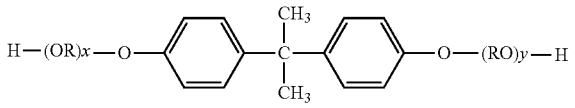

wherein RO and OR are an oxyalkylene group, wherein R is an ethylene and/or propylene group, x and y each shows an average number of moles of the alkylene oxide added, each being a positive number, and the sum of x and y on average is preferably 1 or more, and more preferably 1.5 or more, and preferably 16 or less, more preferably 8 or less, and even more preferably 4 or less. Specific examples of the dihydric alcohol having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

The alcohol component is preferably an alkylene oxide adduct of bisphenol A represented by the formula (I), from the viewpoint of improving dispersibility of the fine fluororesin particles in the toner, thereby inhibiting soiling of a photoconductor derived from paper powders, and from the viewpoint of improving smearing resistance of the toner. The content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

The trihydric or higher polyhydric alcohol includes, for example, trihydric or higher polyhydric alcohols having 3 or more carbon atoms and 20 or less carbon atoms, and preferably 3 or more carbon atoms and 10 or less carbon atoms. Specific examples include sorbitol, 1,4-sorbitan, pentaerythritol, glycerol, trimethylolpropane, and the like.

The dicarboxylic acid compound includes, for example, dicarboxylic acids having 3 or more carbon atoms and 30 or less carbon atoms, preferably having 3 or more carbon atoms and 20 or less carbon atoms, and more preferably having 3 or more carbon atoms and 10 or less carbon atoms; derivatives such as acid anhydrides thereof, and alkyl esters of which alkyl moiety has 1 or more carbon atoms and 3 or less carbon atoms, and the like. Specific examples include aromatic dicarboxylic acid compounds and aliphatic dicarboxylic acid compounds. The aromatic dicarboxylic acid includes phthalic acid, isophthalic acid, terephthalic acid, and the like. The aliphatic dicarboxylic acid includes fumaric acid, maleic acid, succinic acid, glutaric acid, adipic acid, sebacic acid, succinic acid substituted with an alkyl group having 1 or more carbon atoms and 20 or less carbon atoms or an alkenyl group having 2 or more carbon atoms and 20 or less carbon atoms, and the like. Specific examples of the succinic acid substituted with an alkyl group having 1 or more carbon atoms and 20 or less carbon atoms or an alkenyl group having 2 or more carbon atoms and 20 or less carbon atoms include dodecylsuccinic acid, dodecenylsuccinic acid, octenylsuccinic acid, and the like. Among these dicarboxylic acid compounds, at least one member selected from fumaric acid, terephthalic acid, dodecenylsuccinic acid, and acid anhydrides thereof is preferred, from the viewpoint of improving dispersibility of the fine fluororesin particles in the toner, thereby inhibiting soiling of a photoconductor derived from paper powders, and from the viewpoint of improving smearing resistance of the toner.

The content of the dicarboxylic acid compound is preferably 60% by mol or more, more preferably 70% by mol or more, and even more preferably 80% by mol or more, of the carboxylic acid component. In addition, the content of the dicarboxylic acid compound is preferably 99% by mol or less, and more preferably 95% by mol or less, of the carboxylic acid component.

The content of at least one member selected from fumaric acid, terephthalic acid, dodecenylsuccinic acid, and acid anhydrides thereof is preferably 50% by mol or more, more preferably 70% by mol or more, even more preferably 80% by mol or more, even more preferably 90% by mol or more, even more preferably substantially 100% by mol, and even more preferably 100% by mol, of the dicarboxylic acid compound, from the viewpoint of improving dispersibility of the fine fluororesin particles in the toner, thereby inhibiting soiling of a photoconductor derived from paper powders, and from the viewpoint of improving smearing resistance of the toner.

The tricarboxylic or higher polycarboxylic acid compound includes, for example, tricarboxylic or higher polycarboxylic acids having 4 or more carbon atoms and 30 or less carbon atoms, preferably 4 or more carbon atoms and 20 or less carbon atoms, and more preferably 4 or more carbon atoms and 10 or less carbon atoms; derivatives such as acid anhydrides thereof, and alkyl esters of which alkyl moiety has 1 or more carbon atoms and 3 or less carbon atoms, and the like. Specific examples include 1,2,4-benzenetricarboxylic acid (trimellitic acid), 1,2,4,5-benzenetetracarboxylic acid (pyromellitic acid), and the like. Among them, trimellitic acid and acid anhydride thereof are preferred, and trimellitic anhydride is more preferred, from the viewpoint of improving dispersibility of the fine fluororesin particles in the toner, thereby inhibiting soiling of a photoconductor derived from paper powders, and from the viewpoint of improving smearing resistance of the toner.

The content of the tricarboxylic or higher polycarboxylic acid compound is preferably 1% by mol or more, and more preferably 5% by mol or more, and preferably 40% by mol or less, more preferably 30% by mol or less, and even more preferably 20% by mol or less, of the carboxylic acid component, from the viewpoint of improving dispersibility of the fine fluororesin particles in the toner, thereby inhibiting soiling of a photoconductor derived from paper powders, and from the viewpoint of improving smearing resistance of the toner.

Here, the alcohol component may properly contain a monohydric alcohol, and the carboxylic acid component may properly contain a monocarboxylic acid compound, from the viewpoint of adjusting the softening point of the polyester.

An equivalent ratio, i.e. COOH group or groups/OH group or groups, of the carboxylic acid component and the alcohol component is preferably from 0.70 to 1.10, and more preferably from 0.75 to 1.00, from the viewpoint of reducing an acid value of the polyester.

The polycondensation reaction of the alcohol component and the carboxylic acid component can be carried out by polycondensing the components in an inert gas atmosphere at a temperature of from 180° to 250° C. or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The amount of the esterification catalyst used is preferably from 0.01 to 1.5 parts by mass, and more preferably from 0.1 to 1.0 part by mass, based on 100 parts by mass of a total amount of the alcohol component and the carboxylic acid component. It is preferable that the polymerization inhibitor is tert-butyl catechol. The amount used when a polymerization inhibitor is used is preferably from 0.001 to 0.5 parts by mass, and more preferably from 0.01 to 0.1 parts by mass, based on 100 parts by mass of a total amount of the alcohol component and the carboxylic acid component.

The softening point of the polyester is 125° C. or higher, preferably 130° C. or higher, more preferably 135° C. or higher, and even more preferably 137° C. or higher, from the viewpoint of improving dispersibility of the fine fluororesin particles in the toner, thereby inhibiting soiling of a photoconductor derived from paper powders, and from the viewpoint of improving smearing resistance of the toner. Also, the softening point is 170° C. or lower, preferably 160° C. or lower, more preferably 155° C. or lower, and even more preferably 150° C. or lower.

The softening point of the polyester can be controlled by adjusting the kinds and compositional ratios of the alcohol component and the carboxylic acid component, an amount of a catalyst, or the like, or selecting reaction conditions such as reaction temperature, reaction time and reaction pressure.

The glass transition temperature of the polyester is preferably 50° C. or higher, more preferably 55° C. or higher, and even more preferably 58° C. or higher, from the viewpoint of improving dispersibility of the fine fluororesin particles in the toner, thereby inhibiting soiling of a photoconductor derived from paper powders, and from the viewpoint of improving smearing resistance of the toner. Also, the glass transition temperature is preferably 80° C. or lower, more preferably 75° C. or lower, and even more preferably 70° C. or lower. Here, the glass transition temperature is a physical property intrinsically owned by an amorphous resin.

The glass transition temperature of the polyester can be controlled by the kinds, compositional ratios and the like of the alcohol component or the carboxylic acid component.

The acid value of the polyester is preferably 50 mgKOH/g or less, more preferably 30 mgKOH/g or less, and even more preferably 20 mgKOH/g or less, from the viewpoint of improving triboelectric chargeability of the toner, and from the viewpoint of improving dispersibility of the fine fluororesin particles in the toner, thereby inhibiting soiling of a photoconductor derived from paper powders. Also, the acid value is preferably 1 mgKOH/g or more, and more preferably 2 mgKOH/g or more.

The acid value of the polyester can be controlled by adjusting the kinds and compositional ratios of the alcohol component and the carboxylic acid component, an amount of a catalyst, or the like, or selecting reaction conditions such as reaction temperature, reaction time and reaction pressure.

The content of the polyester having a softening point of 125° C. or higher and 170° C. or lower is 50% by mass or more, preferably 65% by mass or more, more preferably 75% by mass or more, even more preferably 85% by mass or more, even more preferably 95% by mass or more, even more preferably substantially 100% by mass, and even more preferably 100% by mass, of the resin binder.

In the present invention, two or more kinds of polyesters may be used as resin binders, from the viewpoint of improving low-temperature fusing ability and productivity of the toner.

When two or more kinds of polyesters are used, it is preferable that the softening point of the overall resin binder is within the range defined above, from the viewpoint of improving dispersibility of the fine fluororesin particles in the toner, thereby inhibiting soiling of a photoconductor derived from paper powders, and from the viewpoint of improving smearing resistance of the toner. Specifically, the softening point of the overall resin binder is preferably 125° C. or higher, more preferably 130° C. or higher, even more preferably 135° C. or higher, and even more preferably 137° C. or higher. Also, the softening point is preferably 170° C. or lower, more preferably 160° C. or lower, even more preferably 155° C. or lower, and even more preferably 150° C. or lower. The softening point of the overall resin binder can be obtained by a weighted average thereof, in other words, the sum of the products of each of softening points and the content ratio.

In addition, when two or more kinds of the polyesters are used, it is preferable that the polyester contains two or more kinds of polyesters of which softening points differ by preferably 10° C. or more, and more preferably 20° C. or more, from the viewpoint of improving dispersibility of the fine fluororesin particles in the toner, thereby inhibiting soiling of a photoconductor derived from paper powders, and from the viewpoint of improving smearing resistance of the toner. Of the two or more kinds of the polyesters, the softening point of the resin having the lowest softening point is preferably 80° C. or higher, more preferably 90° C. or higher, even more preferably 100° C. or higher, and preferably lower than 125° C., more preferably 120° C. or lower, and even more preferably 110° C. or lower, from the viewpoint of improving low-temperature fusing ability of the toner. When the polyester contains two or more kinds of the polyesters, it is preferably that the polyester contains two kinds, from the viewpoint of improving productivity of the toner.

When two kinds of the polyesters are used, a mass ratio of a high-softening point polyester to a low-softening point polyester, i.e. a high-softening point polyester/a low-softening point polyester, is preferably from 99/1 to 65/35, more preferably from 98/2 to 75/25, and even more preferably from 95/5 to 85/25.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

As a resin binder, a resin other than the polyester may be contained within the range that would not impair the effects of the present invention. Other resin binders include, vinyl-based resins, epoxy resins, polycarbonates, polyurethanes, and the like.

[Charge Control Agent]

As the charge control agent, a positively chargeable charge control agent is used. The positively chargeable charge control agent includes non-polymer type positively chargeable charge control agents, including Nigrosine dyes, including, for example, "BONTRON N-01," "BONTRON N-04," "BONTRON N-07," "BONTRON N-79," hereinabove commercially available from Orient Chemical Industries Co., Ltd., "CHUO CCA-3," commercially available from Chuo Synthetic Chemical Co., Ltd., and the like; triphenylmethane-based dyes containing a tertiary amine as a side chain; quaternary ammonium salt compounds including, for example, "BONTRON P-51" commercially available from Orient Chemical Industries Co., Ltd., "TP-415" commercially available from Hodogaya Chemical Co., Ltd., cetyltrimethylammonium bromide, "COPY CHARGE PX VP435," commercially available from Clariant Ltd., and the like; imidazole derivatives including, for example, "PLZ-2001," "PLZ-8001," hereinabove commercially available from Shikoku Chemicals Corporation, and the like; and polymer type positively chargeable charge control agents, including polyamine resins include, for example, "AFP-B" commercially available from Orient Chemical Industries Co., Ltd., and the like; styrene-acrylic resins including, for example, "FCA-201-PS," commercially available from FUJIKURAKASEI CO., LTD., and the like.

Among the positively chargeable charge control agents mentioned above, the Nigrosine dye is preferred, and the Nigrosine dye used together with the quaternary ammonium salt compound is more preferred, from the viewpoint of improving dispersibility of the fine fluororesin particles in the toner, thereby inhibiting soiling of a photoconductor derived from paper powders, and from the viewpoint of improving triboelectric stability and smearing resistance of the toner.

The Nigrosine dye is generally a black mixture composed of a large number of components obtained by polycondensation between nitrobenzene and aniline in the presence of a metal catalyst, and its structure is not fully elucidated. Commercially available Nigrosine dyes, including modified products with a resin acid or the like, include, besides "BONTRON N-01," "BONTRON N-04," "BONTRON N-07," and "BONTRON N-79" mentioned above, "Nigrosine Base EX," "Oil Black BS," "Oil Black SO," "BONTRON N-09," "BONTRON N-11," "BONTRON N-21" hereinabove commercially available from Orient Chemical Industries Co., Ltd., "Nigrosine" commercially available from Ikeda Kagaku Kogyo, "Spirit Black No. 850," "Spirit Black No. 900" hereinabove commercially available from Sumitomo Chemical Co., Ltd., and the like.

The quaternary ammonium salt compound is more preferably a quaternary ammonium salt compound represented by the formula (II):

(II)

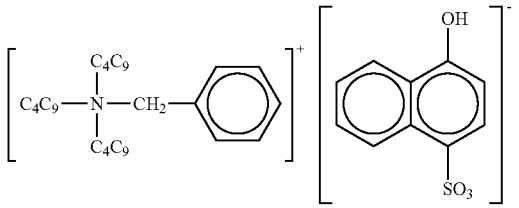

Here, a commercially available product of the quaternary ammonium salt compound represented by the formula (II) is, for example, "BONTRON P-51" mentioned above.

The content of the quaternary ammonium salt compound to be used together with the Nigrosine dye is preferably 5 parts by mass or more, and more preferably 10 parts by mass or more, and even more preferably 15 parts by mass or more, and preferably 80 parts by mass or less, more preferably 70 parts by mass or less, even more preferably 60 parts by mass or less, and even more preferably 50 parts by mass or less, based on 100 parts by mass of the Nigrosine dye.

The content of the positively chargeable charge control agent is preferably 0.3 parts by mass or more, more preferably 1 part by mass or more, even more preferably 1.5 parts by mass or more, and even more preferably 2 parts by mass or more, and preferably 10 parts by mass or less, more preferably 8 parts by mass or less, even more preferably 6 parts by mass or less, and even more preferably 4 parts by mass or less, based on 100 parts by mass of the resin binder in the toner raw material composition in the step 1, from the viewpoint of improving dispersibility of the fine fluororesin particles in the toner, thereby inhibiting soiling of a photoconductor derived from paper powders, and from the viewpoint of improving triboelectric stability and smearing resistance of the toner.

As the charge control agent, negatively chargeable charge control agents may be used together, within the range that would not impair the effects of the present invention.

The negatively chargeable charge control agent includes metal-containing azo dyes, for example, "BONTRON S-28," commercially available from Orient Chemical Industries Co., Ltd., "T-77," commercially available from Hodogaya Chemical Co., Ltd., "BONTRON S-34," commercially available from Orient Chemical Industries Co., Ltd., "AIZEN SPILON BLACK TRH," commercially available from Hodogaya Chemical Co., Ltd., and the like; copper phthalocyanine dyes; metal complexes of alkyl derivatives of salicylic acid, for example, "BONTRON E-81," "BONTRON E-84," "BONTRON E-304," hereinabove commercially available from Orient Chemical Industries Co., Ltd., and the like; nitroimidazole derivatives; boron complexes of benzilic acid, for example, "LR-147," commercially available from Japan Carlit Co., Ltd., and the like; nonmetallic charge control agents, for example, "BONTRON F-21," "BONTRON E-89," hereinabove commercially available from Orient Chemical Industries Co., Ltd., "T-8," commercially available from Hodogaya Chemical Co., Ltd., and the like.

It is preferable that the charge control agent does not contain a negatively chargeable charge control agent. If contained, it is preferable that the content thereof is 0.5 parts by mass or less, based on 100 parts by mass of the resin binder in the toner raw material composition.

[Fine Fluororesin Particles]

The fine fluororesin particles include fine particles made of polytetrafluoroethylene, trifluoroethylene, vinylidene fluoride, fluoroethylene, or the like. Among them, polytetrafluoroethylene having a high melting point and a low coefficient of friction is preferred.

Polytetrafluoroethylene having a nearly spherical shape produced according to emulsion polymerization is preferable. Commercially available products of polytetrafluoroethylene having such a shape include, "LUBRON L-2," commercially available from DAIKIN INDUSTRIES, Ltd., average particle size: 300 nm; "LUBRON L-5," commercially available from DAIKIN INDUSTRIES, Ltd., average particle size: 200 nm; "LUBRON L-5F," commercially available from DAIKIN INDUSTRIES, Ltd., average particle size: 300 nm; "KTL-500F," commercially available from KITAMURA LIMITED, average particle size: 500 nm, and the like.

The fine fluororesin particles have a number-average particle size of preferably 100 nm or more, more preferably 150 nm or more, and even more preferably 200 nm or more, and preferably 1 μm or less, more preferably 800 nm or less, and even more preferably 600 nm or less, from the viewpoint of improving dispersibility of the fine fluororesin particles in the toner, thereby inhibiting soiling of a photoconductor derived from paper powders, and from the viewpoint of improving smearing resistance of the toner. In the present specification, the number-average particle size of the fine fluororesin particles is calculated from a number-average of particle sizes, which is an average of lengths and breadths, determined from a photograph taken with an electron microscope.

The content of the fine fluororesin particles is 0.3 parts by mass or more, preferably 0.5 parts by mass or more, more preferably 0.8 parts by mass or more, even more preferably 1.0 part by mass or more, and even more preferably 1.2 parts by mass or more, based on 100 parts by mass of the resin binder in the toner raw material composition, from the viewpoint of improving dispersibility of the fine fluororesin particles in the toner, thereby inhibiting soiling of a photoconductor derived from paper powders, and from the viewpoint of improving smearing resistance of the toner. Also, the content is 4.5 parts by mass or less, preferably 4.0 parts by mass or less, more preferably 3.5 parts by mass or less, even more preferably 3.0 parts by mass or less, and even more preferably 2.5 parts by mass or less, based on 100 parts by mass of the resin binder in the toner raw material composition, from the viewpoint of improving dispersibility of the fine fluororesin particles in the toner, thereby inhibiting soiling of a photoconductor derived from paper powders.

The toner raw materials may further contain a colorant, a releasing agent, or the like, besides the resin binder, the positively chargeable charge control agent, and the fine fluororesin particles.

[Colorant]

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The toner of the present invention may be any of black toners and color toners. As the colorant, Phthalocyanine Blue 15:3, Phthalocyanine Blue 15:4, and carbon blacks are preferred, from the viewpoint of improving smearing resistance of the toner. In a case where a black toner is obtained, carbon blacks are preferred.

The content of the colorant is preferably 0.5 parts by mass or more, more preferably 1 part by mass or more, and even more preferably 2 parts by mass or more, based on 100 parts by mass of the resin binder in the toner raw material composition, from the viewpoint of improving smearing resistance of the toner, and from the viewpoint of improving optical density of the toner. Also, the content of the colorant is preferably 20 parts by mass or less, more preferably 10 parts by mass or less, and even more preferably 7 parts by mass or less, based on 100 parts by mass of the resin binder in the toner raw material composition, from the viewpoint of improving pulverization efficiency of the melt-kneaded mixture in the step 2, and from the viewpoint of economic advantages.

[Releasing Agent]

The releasing agent includes aliphatic hydrocarbon waxes such as polypropylene wax, polyethylene wax, polypropylene polyethylene copolymer wax, microcrystalline wax, paraffin waxes, and Fischer-Tropsch wax, and oxides thereof; ester waxes such as synthetic ester waxes, carnauba wax, montan wax, sazole wax, and deacidified waxes thereof; fatty acid amides, fatty acids, higher alcohols, metal salts of aliphatic acids, and the like. These releasing agents may be used alone or in a mixture of two or more kinds. Among them, the releasing agent is preferably a polypropylene wax, a paraffin wax, a synthetic ester wax, and carnauba wax, and more preferably a polypropylene wax and carnauba wax, from the viewpoint of improving smearing resistance of the toner.

The content of the releasing agent is preferably 0.5 parts by mass or more, more preferably 1.0 part by mass or more, even more preferably 1.5 parts by mass or more, and even more preferably 2.0 parts by mass or more, based on 100 parts by mass of the resin binder in the toner raw material composition, from the viewpoint of improving smearing resistance of the toner. Also, the content of the releasing agent is preferably 10 parts by mass or less, more preferably 8.0 parts by mass or less, even more preferably 6.0 parts by mass or less, and even more preferably 5.0 parts by mass or less, based on 100 parts by mass of the resin binder.

The melting point of the releasing agent is preferably 160° C. or lower, and more preferably 150° C. or lower, from the viewpoint of improving low-temperature fusing ability of the toner, and the melting point is preferably 60° C. or higher, more preferably 70° C. or higher, and even more preferably 80° C. or higher, from the viewpoint of improving smearing resistance of the toner.

In the present invention, an additive such as a magnetic particulate, a fluidity improver, an electric conductivity modifier, a reinforcing filler such as a fibrous material, an antioxidant, an anti-aging agent, or a cleanability improver may be further properly contained as a toner material.

[Recycled Powder]

The recycled powder usable in the present invention is a powder removed in a classifying step, i.e. the step 3. In the classifying step, fine powders on a smaller particle size side excluded by lower limit classification and coarse powders on a larger particle size side excluded by upper limit classification are removed in accordance with the desired particle size. In the present invention, it is preferable that the recycled powdered are fine particles excluded by lower limit classification, from the viewpoint of increasing efficiencies of melt-kneading in the step 1, thereby improving dispersibility of the fine fluororesin particles in the toner, whereby inhibiting soiling of a photoconductor derived from paper powders, and from the viewpoint of improving smearing resistance of the toner. The recycled powder may be used after melt-kneading again and formed into chips, but the it is preferable that the recycled powder is directly reused without treatments.

The particle sizes of the recycled powder subjected to the melt-kneading step are preferably 10.5 μm or less, and more preferably 6.3 μm or less, from the viewpoint of improving dispersibility of the fine fluororesin particles in the toner, thereby inhibiting soiling of a photoconductor derived from paper powders, and from the viewpoint of improving smearing resistance of the toner. The volume-median particle size $D_{50}$ of the recycled powder is preferably 10 μm or less, more preferably 8 μm or less, even more preferably 5 μm or less, and even more preferably 4 μm or less. In addition, the particle sizes are preferably 1 μm or more, from the viewpoint of productivity. The term volume-median particle size $D_{50}$ as used herein means a particle size of which cumulative volume frequency calculated on a volume percentage is 50% counted from the smaller particle sizes. The volume-median particle size $D_{50}$ of the recycled powder is smaller than a volume-median particle size $D_{50}$ of the toner obtainable in the step 3 or the step 4.

The amount of the recycled powder to be melt-kneaded with the toner raw material composition in the step 1 is 1.5 parts by mass or more, preferably 2.5 parts by mass or more, more preferably 3 parts by mass or more, even more preferably 6 parts by mass or more, and even more preferably 12 parts by mass or more, based on 100 parts by mass of the resin binder in the toner raw material composition, from the viewpoint of improving dispersibility of the fine fluororesin particles in the toner, thereby inhibiting soiling of a photoconductor derived from paper powders, and from the viewpoint of improving smearing resistance of the toner. In addition, the amount of the recycled powder is preferably 50 parts by mass or less, more preferably 40 parts by mass or less, even more preferably 30 parts by mass or less, even more preferably 25 parts by mass or less, and even more preferably 20 parts by mass or less, based on 100 parts by mass of the resin binder, from the viewpoint of reusing fine powders and from the viewpoint of productivity.

A mass ratio of the recycled powder to be melt-kneaded to the toner raw material composition in the step 1, i.e. the recycled powder/the toner raw material composition, is preferably from 1.0/100 to 30/100, more preferably from 2.5/100 to 25/100, and even more preferably from 5.0/100 to 20/100, from the viewpoint of improving dispersibility of the fine fluororesin particles in the toner, thereby inhibiting soiling of a photoconductor derived from paper powders, from the viewpoint of improving smearing resistance of the toner, from the viewpoint of reusing fine powders, and from the viewpoint of productivity.

The amount of the fine fluororesin particles in the recycled powder in the step 1 is preferably 1.5 parts by mass or more, more preferably 2.5 parts by mass or more, even more preferably 7 parts by mass or more, and even more preferably 12 parts by mass or more, based on 100 parts by mass of the fine fluororesin particles in the toner raw material composition, from the viewpoint of inhibiting soiling of a photoconductor derived from paper powders, and from the viewpoint of improving smearing resistance of the toner. The amount of the fine fluororesin particles is preferably 50 parts by mass or less, more preferably 40 parts by mass or less, and even more preferably 30 parts by mass or less, based on 100 parts by mass of the fine fluororesin particles, from the viewpoint of reusing fine powders and from the viewpoint of productivity.

[Step 1]

The step 1 can be carried out with a known kneader, such as a closed kneader, a single-screw or twin-screw kneader, or a continuous open-roller type kneader, and the step 1 is preferably carried out with a twin-screw kneader. The twin-screw kneader refers to a closed-type kneader in which two kneading screws are covered with barrel, and it is preferable that the twin-screw kneader is a type of which screws can be rotated in the same direction of the screw rotations, from the viewpoint of improving dispersibility of the fine fluororesin particles in the toner. As commercially available products, twin-screw extruders, PCM Series commercially available from IKEGAI Corporation, which allow excellent engagement of the two screws at high speeds, are preferred, from the viewpoint of improving productivity of the toner.

It is preferable that the toner raw material composition and the recycled powder are previously mixed with a Henschel mixer, a ball-mill or the like, and thereafter fed to the kneader.

The melt-kneading with the twin-screw kneader is carried out by adjusting a barrel setting temperature, i.e. a temperature of an internal wall side of the extruder, peripheral speeds of the screw rotation of the twin screws, and supplying rates of raw materials. From the viewpoint of improving dispersibility of the fine fluororesin particles in the toner, thereby inhibiting soiling of a photoconductor derived from paper powders, and from the viewpoint of improving smearing resistance of the toner, the barrel setting temperature is preferably 80° C. or higher, and more preferably 90° C. or higher, and the barrel setting temperature is preferably 140° C. or lower, and more preferably 120° C. or lower.

The peripheral speed of the screw rotation of the twin screws is preferably from 0.1 m/sec or more and 1 m/sec or less, from the viewpoint of improving dispersibility of the fine fluororesin particles in the toner, thereby inhibiting soiling of a photoconductor derived from paper powders, and from the viewpoint of improving smearing resistance of the toner.

The feeding rates for the raw materials to the twin-screw kneader are appropriately adjusted in accordance with the allowable capacity of the kneader used and the barrel setting temperature and the peripheral speed of the screw rotations mentioned above.

[Step 2]

The step 2 is a step of cooling a melt-kneaded mixture obtained in the step in the step 1, and pulverizing a cooled mixture. It is preferable that the pulverizing step is carried out after cooling the resin mixture obtained in the step 1 to a temperature of 40° C. or lower, while pressing to a thickness of from 1 to 3 mm.

The pulverizing step may be carried out in divided multi-stages. For example, the resin mixture may be roughly pulverized to a size of from 0.1 to 5 mm or so, and the roughly pulverized product may then be further finely pulverized to a desired particle size.

The pulverizer usable in the pulverizing step is not particularly limited. For example, the pulverizer preferably usable in the rough pulverization includes a hammer-mill, a cutter-mill, an atomizer, Rotoplex, and the like, and the pulverizer suitably usable in the fine pulverization includes a fluidised bed opposed jet mill, an impact type jet mill, a rotary mechanical mill, and the like. It is preferable to use a fluidised bed opposed jet mill and an impact type jet mill, and it is more preferable to use an impact type jet mill, from the viewpoint of pulverization efficiency.

[Step 3]

The step 3 is a step of classifying a pulverized product obtained in the step 2. The classifier usable in the classifying step includes an air classifier, an inertial classifier, a sieve classifier, and the like. During the classifying step, the pulverized product which is excluded in an upper limit classification side as being insufficiently pulverized, i.e. a roughly pulverized product, may be subjected to the pulverization step again, and the pulverization step and the classifying step may be repeated as occasion demands. As mentioned above, the powder excluded by this classifying step is used as a recycled powder.

The content of the fine fluororesin particles in the toner obtained in the step 3 is preferably 0.5 parts by mass or more, more preferably 1 part by mass or more, and even more preferably 1.5 parts by mass or more, based on 100 parts by mass of the resin binder in the toner raw material composition, from the viewpoint of improving dispersibility of the fine fluororesin particles in the toner, thereby inhibiting soiling of a photoconductor derived from paper powders, and from the viewpoint of improving smearing resistance of the toner. In addition, the content is preferably 5 parts by mass or less, more preferably 4 parts by mass or less, and even more preferably 3 parts by mass or less, based on 100 parts by mass of the resin binder in the toner raw material composition, from the viewpoint of improving dispersibility of the fine fluororesin particles in the toner, thereby inhibiting soiling of a photoconductor derived from paper powders.

The volume-medium particle size $D_{50}$ of the toner obtained in the step 3 is preferably 3 μm or more, more preferably 4 μm or more, even more preferably 6 μm or more, and even more preferably 8 μm or more, from the viewpoint of improving image quality of the toner. In addition, the volume-median particle size is preferably 15 μm or less, and more preferably 12 μm or less. The term volume-median particle size $D_{50}$ as used herein means a particle size of which cumulative volume frequency calculated on a volume percentage is 50% counted from the smaller particle sizes.

It is preferable that the method for producing a toner of the present invention further includes a step 4 of mixing a classified product obtained in the step 3, as the toner matrix particles, with an external additive, from the viewpoint of improving triboelectric chargeability, fluidity, and transferability of the toner. The external additive includes, for example, fine inorganic particles of silica, alumina, titania, zirconia, tin oxide, zinc oxide, and the like, and fine organic particles such as resin particles such as fine melamine resin particles and fine polytetrafluoroethylene resin particles. The external additive may be used in combination of two or more kinds. Among them, silica is preferred, and a hydrophobic silica that is hydrophobically treated is more preferred, from the viewpoint of transferability of the toner.

The number-average particle size of the external additive is preferably 5 nm or more, and more preferably 7 nm or more, and preferably 250 nm or less, more preferably 200 nm or less, and even more preferably 90 nm or less, from the viewpoint of improving triboelectric chargeability, fluidity, and transferability of the toner.

The content of the external additive is preferably 0.1 parts by mass or more, and more preferably 0.3 parts by mass or more, and preferably 5 parts by mass or less, more preferably 3 parts by mass or less, and even more preferably 1 part by mass or less, based on 100 parts by mass of the toner matrix particles before the treatment with the external additive, from the viewpoint of improving triboelectric chargeability, fluidity, and transferability of the toner.

In the mixing of the toner matrix particles with an external additive, a mixer having an agitating member such as rotary blades is preferably used, more preferably a high-speed mixer such as a Henschel mixer or Super Mixer, and even more preferably a Henschel mixer.

The preferred value for the volume-median particle size $D_{50}$ of the toner obtained in the step 4 is the same as that for the volume-median particle size $D_{50}$ of the toner obtained in the step 3.

The toner of the present invention can be used as a toner directly for monocomponent development, or as a toner for use in a two-component development prepared by mixing a toner with a carrier. From the viewpoint of obtaining stable triboelectric chargeability even under stirring conditions with a carrier, the toner can be suitably used in an apparatus for forming fused images of a nonmagnetic development, especially nonmagnetic two-component development.

In the present invention, as a carrier, a carrier having a low saturation magnetization which has a weaker contact with a magnetic brush is preferable, from the viewpoint of the image properties. The carrier has a saturation magnetization of preferably from 40 to 100 $Am^2/kg$, and more preferably from 50 to 90 $Am^2/kg$. The carrier has a saturation magnetization of preferably 100 $Am^2/kg$ or less, from the viewpoint of controlling the hardness of the magnetic brush and retaining the tone reproducibility of images, and the carrier has a saturation magnetization of preferably 40 $Am^2/kg$ or more, from the viewpoint of preventing adhesion of the carrier and toner dust.

It is preferable that a carrier comprises a core material and a coating material.

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; glass beads; and the like. Among them, magnetite, ferrite, copper-zinc-magnesium ferrite, and manganese ferrite are preferable, and ferrite is more preferable, from the viewpoint of improving triboelectric stability of a toner, and maintaining an optical density.

The surface of the carrier may be coated with a resin, from the viewpoint of preventing the formation of toner scumming on the carrier. The resin for coating the surface of the carrier may vary depending upon the raw materials for toners to be used together, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. The silicone resin are preferred, from the viewpoint of improving triboelectric stability of a toner, and maintaining an optical density. These resins can be used alone or in a combination of two or more kinds.

The method of coating a core material with a resin includes, but not particularly limited to, for example, a method of dissolving or suspending a coating material such as a resin in a solvent, and applying the solution or suspension to be deposited on a core material, a method of blending a resin powder and a core material to be deposited on a core material, and the like.

In a two-component developer obtainable by mixing a toner with a carrier, the content of the toner is preferably 2% by mass or more of the two-component developer, from the viewpoint of improving dispersibility of fine fluororesin particles in the toner, thereby inhibiting soiling of a photoconductor derived from paper powders, and from the viewpoint of improving smearing resistance of the toner. In addition, the content of the toner is preferably 10% by mass or less, more preferably 8% by mass or less, and even more preferably 5% by mass or less, of the two-component developer, from the viewpoint of improving triboelectric stability of a toner, and maintaining an optical density.

[Method for Forming Fused Images]

The method for forming fused images of the present invention is a method for forming fused images including applying a positively chargeable toner obtained by the method of the present invention. More specifically, the method for forming fused images includes charging a photoconductor; exposing the photoconductor; developing including adhering a positively chargeable toner as defined above to an electrostatic latent image formed on the photoconductor, to form a visible image; transferring a formed visible image to a printout sheet; and fusing a transferred visible image to the printout sheet.

[Printout Sheets]

The printout sheets suitable in the present invention are papers that are more likely to generate paper powders, such as papers having a large content of deinked pulps, i.e. waste papers, and papers having low surface strength due to insufficient effects of paper strengthening agents and surface-coating agents. The above-described printout sheets have a low smoothness, and it is preferable to use papers having a Bekk smoothness of preferably 60 seconds ("S") or less, more preferably 50 S or less, and even more preferably 40 S or less, Here, the lower limit of the Bekk smoothness is preferably 10 S or more.

In addition, in the above papers, for the purpose of giving whiteness or smoothening the surface of papers, there are many cases where calcium carbonate is added as a filler. Therefore, papers contain calcium carbonate in an amount of preferably 8% by mass or more, and more preferably 10% by mass or more. Here, the upper limit of the content of calcium carbonate is preferably 20% by mass or less.

Regarding the embodiments mentioned above, the present invention will further disclose a positively chargeable toner and a method for producing the toner as set forth below.

<1> A method for producing a positively chargeable toner, including:

step 1: melt-kneading a toner raw material composition containing a resin binder, a positively chargeable charge control agent, and fine fluororesin particles, and a recycled powder;

step 2: cooling a melt-kneaded mixture obtained in the step 1, and pulverizing a cooled mixture; and step 3: classifying a pulverized product obtained in the step 2, wherein the recycled powder is a powder removed in the step 3, wherein the amount of the recycled powder melt-kneaded with the toner raw material composition in the step 1 is 1.5 parts by mass or more, based on 100 parts by mass of the resin binder in the toner raw material composition, and wherein the resin binder in the toner raw material composition contains 50% by mass or more of a polyester having a softening point of 125° C. or higher and 170° C. or lower, and wherein the content of the fine fluororesin particles in the toner raw material composition in the step 1 is 0.3 parts by mass or more and 4.5 parts by mass or less, based on 100 parts by mass of the resin binder in the toner raw material composition.

<2> The method according to the above <1>, wherein an alcohol component of the polyester having a softening point of 125° C. or higher and 170° C. or lower contains an alkylene oxide adduct of bisphenol A represented by the formula (I).

<3> The method according to the above <2>, wherein the content of the alkylene oxide adduct of bisphenol A represented by the formula (I) is preferably 50% by mol or more, more preferably 70% by mol or more, even more preferably 90% by mol or more, even more preferably substantially 100% by mol, and even more preferably 100% by mol, of the alcohol component.

<4> The method according to any one of the above <1> to <3>, wherein a carboxylic component of the polyester having a softening point of 125° C. or higher and 170° C. or lower contains at least one member selected from fumaric acid, terephthalic acid, dodecenylsuccinic acid, and acid anhydrides thereof.

<5> The method according to the above <4>, wherein the content of at least one member selected from fumaric acid, terephthalic acid, dodecenylsuccinic acid, and acid anhydrides thereof is preferably 50% by mol or more, more preferably 70% by mol or more, even more preferably 80% by mol or more, even more preferably 90% by mol or more, even more preferably substantially 100% by mol, and even more preferably 100% by mol, of the dicarboxylic acid compound.

<6> The method according to any one of the above <1> to <5>, wherein a carboxylic component of the polyester having a softening point of 125° C. or higher and 170° C. or lower contains a tricarboxylic or higher polycarboxylic acid compound, and the content of the tricarboxylic or higher polycarboxylic acid compound is preferably 1% by mol or more, and more preferably 5% by mol or more, and preferably 40% by mol or less, more preferably 30% by mol or less, and even more preferably 20% by mol or less, of the carboxylic acid component, <7> The method according to any one of the above <1> to <6>, wherein the softening point of the polyester having a softening point of 125° C. or higher and 170° C. or lower is preferably 130° C. or higher, more preferably 135° C. or higher, and even more preferably 137° C. or higher, and preferably 160° C. or lower, more preferably 155° C. or lower, and even more preferably 150° C. or lower.

<8> The method according to any one of the above <1> to <7>, wherein the glass transition temperature of the polyester having a softening point of 125° C. or higher and 170° C. or lower is preferably 50° C. or higher, more preferably 55° C. or higher, and even more preferably 58° C. or higher, and preferably 80° C. or lower, more preferably 75° C. or lower, and even more preferably 70° C. or lower.

<9> The method according to any one of the above <1> to <8>, wherein the acid value of the polyester having a softening point of 125° C. or higher and 170° C. or lower is preferably 50 mgKOH/g or less, more preferably 30 mgKOH/g or less, and even more preferably 20 mgKOH/g or less, and preferably 1 mgKOH/g or more, and more preferably 2 mgKOH/g or more.

<10> The method according to any one of the above <1> to <9>, wherein the content of the polyester having a softening point of 125° C. or higher and 170° C. or lower is preferably 65% by mass or more, more preferably 75% by mass or more, even more preferably 85% by mass or more, even more preferably 95% by mass or more, even more preferably substantially 100% by mass, and even more preferably 100% by mass, of the resin binder.

<11> The method according to any one of the above <1> to <10>, wherein the resin binder contains two or more kinds of polyesters, and wherein the softening point of the overall resin binder is preferably 125° C. or higher, more preferably 130° C. or higher, even more preferably 135° C. or higher, and even more preferably 137° C. or higher, and preferably 170° C. or lower, more preferably 160° C. or lower, even more preferably 155° C. or lower, and even more preferably 150° C. or lower.

<12> The method according to any one of the above <1> to <11>, wherein the resin binder contains two or more kinds of the polyesters of which softening points differ by preferably 10° C. or more, and more preferably 20° C. or more, and wherein the softening point of the resin having the lowest softening point is preferably 80° C. or higher, more preferably 90° C. or higher, even more preferably 100° C. or higher, and preferably lower than 125° C., more preferably 120° C. or lower, and even more preferably 110° C. or lower.

<13> The method according to the above <12>, wherein a mass ratio of a softening point of a resin having the highest softening point (high-softening point polyester) to a resin having the lowest softening point (low-softening point polyester), i.e. a high-softening point polyester/a low-softening point polyester, is preferably from 99/1 to 65/35, more preferably from 98/2 to 75/25, and even more preferably from 95/5 to 85/25.

<14> The method according to any one of the above <1> to <13>, wherein the content of the fine fluororesin particles in the recycled powder is preferably 1.5 parts by mass or more, more preferably 2.5 parts by mass or more, even more preferably 7 parts by mass or more, and even more preferably 12 parts by mass or more, and preferably 50 parts by mass or less, more preferably 40 parts by mass or less, and even more preferably 30 parts by mass or less, based on 100 parts by mass of the fine fluororesin particles.

<15> The method according to any one of the above <1> to <14>, wherein the positively chargeable charge control agent contains Nigrosine dye.

<16> The method according to the above <15>, wherein the positively chargeable charge control agent further contains a quaternary ammonium salt compound.

<17> The method according to the above <16>, wherein the quaternary ammonium salt compound is a quaternary ammonium salt compound represented by the formula (II).

<18> The method according to the above <16> or <17>, wherein the content of the quaternary ammonium salt compound is preferably 5 parts by mass or more, and more preferably 10 parts by mass or more, and even more preferably 15 parts by mass or more, and preferably 80 parts by mass or less, more preferably 70 parts by mass or less, even more preferably 60 parts by mass or less, and even more preferably 50 parts by mass or less, based on 100 parts by mass of the Nigrosine dye.

<19> The method according to any one of the above <1> to <18>, wherein the content of the positively chargeable charge control agent is preferably 0.3 parts by mass or more, more preferably 1 part by mass or more, even more preferably 1.5 parts by mass or more, and even more preferably 2 parts by mass or more, and preferably 10 parts by mass or less, more preferably 8 parts by mass or less, even more preferably 6 parts by mass or less, and even more preferably 4 parts by mass or less, based on 100 parts by mass of the resin binder in the toner raw material composition in the step 1.

<20> The method according to any one of the above <1> to <19>, wherein the fine fluororesin particles are made of polytetrafluoroethylene.

<21> The method according to any one of the above <1> to <20>, wherein the fine fluororesin particles have a number-average particle size of preferably 100 nm or more, more preferably 150 nm or more, and even more preferably 200 nm or more, and preferably 1 μm or less, more preferably 800 nm or less, and even more preferably 600 nm or less.

<22> The method according to any one of the above <1> to <21>, wherein the content of the fine fluororesin particles is preferably 0.5 parts by mass or more, more preferably 0.8 parts by mass or more, even more preferably 1.0 part by mass or more, and even more preferably 1.2 parts by mass or more, and preferably 4.0 parts by mass or less, more preferably 3.5 parts by mass or less, even more preferably 3.0 parts by mass or less, and even more preferably 2.5 parts by mass or less, based on 100 parts by mass of the resin binder in the toner raw material composition.

<23> The method according to any one of the above <1> to <22>, wherein the particle sizes of the recycled powder subjected to the melt-kneading step are preferably 10.5 μm or less, and more preferably 6.3 μm or less.

<24> The method according to any one of the above <1> to <23>, wherein the volume-median particle size $D_{50}$ of the recycled powder subjected to the melt-kneading step is preferably 10 μm or less, more preferably 8 μm or less, even more preferably 5 μm or less, and even more preferably 4 μm or less, and preferably 1 μm or more.

<25> The method according to any one of the above <1> to <24>, wherein the amount of the recycled powder to be melt-kneaded with the toner raw material composition in the step 1 is preferably 2.5 parts by mass or more, more preferably 3 parts by mass or more, even more preferably 6 parts by mass or more, and even more preferably 12 parts by mass or more, and preferably 50 parts by mass or less, more preferably 40 parts by mass or less, even more preferably 30 parts by mass or less, even more preferably 25 parts by mass or less, and even more preferably 20 parts by mass or less, based on 100 parts by mass of the resin binder in the toner raw material composition.

<26> The method according to any one of the above <1> to <25>, wherein a mass ratio of the recycled powder to be melt-kneaded to the toner raw material composition in the step 1, i.e. the recycled powder/the toner raw material composition, is preferably from 1.0/100 to 30/100, more preferably from 2.5/100 to 25/100, and even more preferably from 5.0/100 to 20/100.

<27> The method according to any one of the above <1> to <26>, wherein the melt-kneading in the step 1 is carried out with a twin-screw kneader.

<28> The method according to any one of the above <1> to <27>, wherein in the step 3, the pulverized product which is excluded in an upper limit classification side is subjected to the pulverization step again, and the pulverization step and the classifying step are repeated as occasion demands.

<29> The method according to any one of the above <1> to <28>, wherein the content of the fine fluororesin particles in the toner obtained in the step 3 is preferably 0.5 parts by mass or more, more preferably 1 part by mass or more, and even more preferably 1.5 parts by mass or more, and preferably 5 parts by mass or less, more preferably 4 parts by mass or less, and even more preferably 3 parts by mass or less, based on 100 parts by mass of the resin binder in the toner raw material composition.

<30> The method according to any one of the above <1> to <29>, wherein the volume-medium particle size $D_{50}$ of the toner obtained in the step 3 is preferably 3 μm or more, more preferably 4 μm or more, even more preferably 6 μm or more, and even more preferably 8 μm or more, and preferably 15 μm or less, and more preferably 12 μm or less.

<31> The method according to any one of the above <1> to <30>, further including the step 4 of mixing a classified product obtained in the step 3 with an external additive.

<32> The method according to the above <31>, wherein the external additive is preferably silica, and more preferably a hydrophobic silica that is hydrophobically treated.

<33> The method according to the above <31> or <32>, wherein the number-average particle size of the external additive is preferably 5 nm or more, and more preferably 7 nm or more, and preferably 250 nm or less, more preferably 200 nm or less, and even more preferably 90 nm or less.

<34> A positively chargeable toner obtainable by the method as defined in any one of the above <1> to <33>.

<35> The positively chargeable toner according to the above <34>, wherein the positively chargeable toner is suitably used in an apparatus for forming fused images of a non-magnetic development, especially nonmagnetic two-component development, as a toner directly for monocomponent development, or as a toner for use in a two-component development prepared by mixing a toner with a carrier.

<36> The positively chargeable toner according to the above <35>, wherein the carrier has a saturation magnetization of preferably from 40 to 100 $Am^2/kg$, and more preferably from 50 to 90 $Am^2/kg$.

<37> The positively chargeable toner according to the above <35> or <36>, in a two-component developer obtainable by mixing a toner with a carrier, the content of the toner is preferably 2% by mass or more, and preferably 10% by mass or less, more preferably 8% by mass or less, and even more preferably 5% by mass or less of the two-component developer.

<38> A method for forming fused images, including:

charging a photoconductor;

exposing the photoconductor;

developing including adhering a positively chargeable toner as defined in any one of the above <34> to <37> to an electrostatic latent image formed on the photoconductor, to form a visible image;

transferring a formed visible image to a printout sheet; and fusing a transferred visible image to the printout sheet.

<39> The method for forming fused images according to the above <38>, the Bekk smoothness of the printout sheet is preferably 60 S or less, more preferably 50 S or less, and even more preferably 40 S or less, and preferably 10 S or more.

<40> The method for forming fused images according to the above <38> or <39>, wherein the content of calcium carbonate of the printout sheet is preferably 8% by mass or more, and more preferably 10% by mass or more, and preferably 20% by mass or less.

EXAMPLES

The following examples further describe and demonstrate embodiments of the present invention. The examples are given solely for the purposes of illustration and are not to be construed as limitations of the present invention. The physical properties of the resins and the like were measured by the following methods.

Softening Point of Resin

The softening point refers to a temperature at which half of the sample flows out, when plotting a downward movement of a plunger of a flow tester "CFT-500D", commercially available from Shimadzu Corporation, against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

Glass Transition Temperature of Resin

The glass transition temperature refers to a temperature of an intersection of the extension of the baseline of equal to or lower than the temperature of the maximum endothermic peak and the tangential line showing the maximum inclination between the kick-off of the peak and the top of the peak, wherein the endothermic peaks are measured by heating a 0.01 to 0.02 g sample weighed out in an aluminum pan to 200° C., cooling the sample from that temperature to −10° C. at a cooling rate of 10° C./min, thereafter raising the temperature of the sample at a heating rate of 10° C./min, and thereafter raising the temperature of from 25° to 120° C., of the sample at a heating rate of 10° C./min, using a differential scanning calorimeter "DSC 210," commercially available from Seiko Instruments Inc.

Acid Value of Resin

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

Number-Average Particle Size of Fine Fluororesin Particles

Particle sizes are determined for 100 particles from a photograph taken with a scanning electron microscope (SEM), an average of length and breadth of the particles of which is taken, the particle sizes being taken at an appropriate magnification of a magnification of from 5,000 to 50,000, and the average is referred to as a number-average particle size.

Melting Point of Releasing Agent

Measurements are taken using a differential scanning calorimeter "DSC 210," commercially available from Seiko Instruments Inc., by weighing out a 0.01 to 0.02 g sample in an aluminum pan, heating the sample to 200° C., and cooling the sample from that temperature to 0° C. at a cooling rate of 10° C./min. Next, the measurements are taken while heating the sample at a rate of 10° C./min to 180° C. A highest temperature of endothermic peak observed in the melting endothermic curve in the above measurements obtained is defined as a melting point of a releasing agent.

Number-Average Particle Size of External Additive

Particle sizes are determined for 500 particles from a photograph taken with a scanning electron microscope (SEM), an average of length and breadth of the particles of which is taken, and the average is referred to as a number-average particle size.

Volume-Median Particle Size $D_{50}$ of Recycled Powder and Toner

Measuring Apparatus: Coulter Multisizer II, commercially available from Beckman Coulter, Inc.

Aperture Diameter: 100 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6, is dissolved in the above electrolytic solution so as to have a concentration of 5% by mass to provide a dispersion.

Dispersion Conditions: Ten milligrams of a measurement sample is added to 5 ml of the above dispersion, and the mixture is dispersed with an ultrasonic disperser US-1 manufactured by SND, output: 80 W, for 1 minute, and 25 ml of the above electrolytic solution is added to the dispersion, and further dispersed with the ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

Saturation Magnetization of Carrier (1) A carrier is filled in a plastic case with a lid while tapping, the case having an outer diameter of 7 mm (inner diameter of 6 mm) and a height of 5 mm. The mass of the carrier is determined from a difference of the mass of the plastic case and the mass of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturation magnetization is determined by applying a magnetic field of 79.6 kA/m, while vibrating the plastic case using the vibration function. The value obtained is calculated as the saturation magnetization per unit mass, taking into consideration the mass of the filled carrier.

Bekk Smoothness of Printout Sheets

The Bekk smoothness is measured in accordance with a Bekk testing machine method as defined in JIS P8119 (ISO 5627).

Content of Calcium Carbonate of Printout Sheets

The content of calcium carbonate is measured in accordance with ICP emission analysis method.

Production Example 1 of Resin—Resin A

A 10-liter four-neck flask equipped with a nitrogen inlet tube, a dehydration tube, a stirrer, and a thermocouple was charged with 2,450 g (7 mol) of polyoxypropylene(2.2)-2,2-bis(4-hydroxyphenyl)propane, 975 g (3 mol) of polyoxyethylene(2.2)-2,2-bis(4-hydroxyphenyl)propane, 963 g (5.8 mol) of terephthalic acid, 343 g (1.3 mol) of dodecenylsuccinic anhydride, 289 g (1.5 mol) of trimellitic anhydride, and 10 g of dibutyltin oxide. The contents were heated to 230° C. under nitrogen atmosphere, and subjected to a reaction until a reaction percentage reached 90%, and the reaction mixture was further subjected to a reaction at 8.3 kPa until a softening point reached 140° C., to provide a resin A. The resin A had a softening point of 140° C., a glass transition temperature of 62° C., and an acid value of 6.8 mgKOH/g. Here, the reaction percentage as used herein means a value calculated by: [amount of generated water in reaction (mol)/theoretical amount of generated water (mol)]×100.

Production Example 2 of Resin—Resin B

A 10-liter four-neck flask equipped with a nitrogen inlet tube, a dehydration tube, a stirrer, and a thermocouple was charged with 3,812 g (10.9 mol) of polyoxypropylene(2.2)-2,2-bis(4-hydroxyphenyl)propane, 35 g (0.1 mol) of polyoxyethylene(2.2)-2,2-bis(4-hydroxyphenyl)propane, 546 g (3.3 mol) of terephthalic acid, and 10 g of dibutyltin oxide. The contents were heated to 230° C. under nitrogen atmosphere, and subjected to a reaction until a reaction percentage reached 90%, and the reaction mixture was further subjected to a reaction at 8.3 kPa for 1 hour. Next, the temperature was lowered to 185° C., and the pressure was recovered to an ambient pressure, i.e. 101.3 kPa, and 826 g of fumaric acid and 2.4 g of tertiary butyl catechol were supplied thereinto, and a mixture was subjected to a reaction at an ambient pressure while heating to 210° C. for over 4 hours, and then subjected to a reaction at 8.3 kPa until a softening point reached 104° C., to provide a resin B. The resin B had a softening point of 104° C., a glass transition temperature of 60° C., and an acid value of 10.4 mgKOH/g.

Examples 1 to 16 and Comparative Examples 3 to 5

Melt-Kneading Step

Resin binders and fine fluororesin particles "LUBRON L-5F" commercially available from DAIKIN INDUSTRIES, Ltd., polytetrafluoroethylene, average particle size of 300 nm, as listed in Table 1, 4.5 parts by mass of a carbon black "Regal 330R" commercially available from Cabot Corporation, 2 parts by mass of a positively chargeable charge control agent "BONTRON N-79" commercially available from Orient Chemical Industries Co., Ltd., 0.5 parts by mass of a positively chargeable charge control agent "BONTRON P-51" commercially available from Orient Chemical Industries Co., Ltd., 1 part by mass of a releasing agent "Biscol 660P" commercially available from Sanyo Chemical Industries, Ltd., polypropylene wax, melting point: 145° C., and 3 parts by mass of a releasing agent "Carnauba Wax C2" commercially available from S. Kato & CO., carnauba wax, melting point: 85° C. were pre-mixed with a Henschel mixer for one minute, and the mixture was then melt-kneaded with a twin-screw extruder "PCM-87," commercially available from IKEGAI Corporation. The operating conditions for melt-kneading were such that a feeding rate of the raw materials was 2.5 kg/min, that a barrel setting temperature was 100° C., and that a rotational speed of the screw at a screw kneading section was 180 r/min, a peripheral speed of the screw rotation being 0.30 m/sec.

Pulverizing Step

The resulting melt-kneaded mixture was cooled with a drum flaker. The cooled melt-kneaded mixture was roughly pulverized to a volume-median particle size $D_{50}$ of from 1.5 to 2.5 mm with a cutter mill commercially available from NARA MACHINERY CO., LTD., and then finely pulverized with an impact type jet mill "Model 1-20" commercially available from Nippon Pneumatic Mfg. Co., Ltd.

Classifying Step

The resulting pulverized product was classified with an air classifier "Model DSF" commercially available from Nippon Pneumatic Mfg. Co., Ltd., to provide first toner matrix particles having a volume-median particle size $D_{50}$ of 10 μm, and classified fine powders, i.e. recycled powder, having a volume-median particle size $D_{50}$ of 3.5 μm.

Melt-Kneading Step, Pulverizing Step, and Classifying Step

The same procedures as in the melt-kneading step, i.e. the step 1, the pulverizing step, i.e. the step 2, and the classifying step, the step 3 were carried out except that the resulting recycled powder was used in an amount as listed in Table 1 in the melt-kneading step, to provide second toner matrix particles having a volume-median particle size $D_{50}$ of 10 μm.

External Additive Treatment Step—Step 4

One hundred parts by mass of the second toner matrix particles obtained were mixed with 0.3 parts by mass of a hydrophobic silica "HDK H30TD," commercially available from Clariant Ltd., number-average particle size: 8 nm, and 0.2 parts by mass of a hydrophobic silica "CAB-O-SIL TG-820F," commercially available from Cabot Corporation, number-average particle size: 8 nm, with a Henschel mixer at 1,500 r/min for 3 minutes, to provide each of the toners.

Here, as to the item "Amount of Fine Fluororesin Particles in Recycled Powder," in the case of Example 1 would be as follows: Components were composed of 100 parts by mass of the resin binders, 2 parts by mass of fine fluororesin particles, 4.5 parts by mass of a carbon black, 2 parts by mass of a positively chargeable charge control agent, 0.5 parts by mass of a positively chargeable charge control agent, 1 part by mass of a releasing agent "Biscol 660P," and 3 parts by mass of a releasing agent "Carnauba Wax C2," a total of 113 parts by mass, and the amount of the recycled powder was 15 parts by mass, so that the amount of the fine particles would be calculated to be: 2×15/113=0.27 parts by mass. Therefore, "Amount of Fine Fluororesin Particles in Recycled Powder Based on 100 Parts by Mass of Fine Fluororesin Particles in Toner Raw Material Composition" would be calculated to be 0.27×100/2=13.5 parts by mass.

Comparative Example 1

One hundred parts by mass of the first toner matrix particles obtained in Example 1 were mixed with 0.3 parts by mass of a hydrophobic silica "HDK H30TD," commercially available from Clariant Ltd., number-average particle size: 8 nm, and 0.2 parts by mass of a hydrophobic silica "Cabosil TG-820F," commercially available from Cabot, number-average particle size: 8 nm, with a Henschel mixer at 1,500 r/min for 3 minutes, to provide a toner.

Comparative Example 2

The same procedures as in Example 1 were carried out except that the fine fluororesin particles were not used, to provide primary toner matrix particles.

One hundred parts by mass of the first toner matrix particles obtained were mixed with 0.3 parts by mass of a hydrophobic silica "HDK H30TD," commercially available from Clariant Ltd., number-average particle size: 8 nm, and 0.2 parts by mass of a hydrophobic silica "Cabosil TG-820F," commercially available from Cabot, number-average particle size: 8 nm, with a Henschel mixer at 1,500 r/min for 3 minutes, to provide a toner.

Comparative Example 6

The same procedures as in Example 1 were carried out except that 2 parts by mass of a silica "Cabosil TG-820F" commercially available from Cabot were used in place of the fine fluororesin particles, to provide a toner.

Thirty-nine parts by mass of a toner obtained in Examples and Comparative Examples and 1,261 parts by mass of a carrier (ferrite core, silicone-coated, saturation magnetization: 71 $Am^2/kg$) were mixed with a V-blender commercially available from Ikemoto Scientific Technology Co., Ltd., to provide a two-component developer. Here, as the carrier, a carrier alone that was prepared by separating a developer for Infoprint 4100 (P/N17R7726) into a toner and a carrier was used.

Test Example 1

Photoconductor Soiling Test

Three magnetic rollers of a contact development developer device "Infoprint 4000IS1" commercially available from Ricoh, linear speed: 1,066 mm/sec, resolution: 240 dpi, development system: three magnet rollers, selenic photoconductor, reversal development, were set at angles of magnetic poles of a developer roller A: 7.5 degrees, a developer roller B: 0 degrees, and a developer roller C: 0 degrees. In addition, a gap between the developer roller A and a doctor blade was adjusted to 0.70 mm, and a gap between the developer roller B and a doctor blade was adjusted to 0.95 mm. A two-component developer was loaded to the contact development developer device, and print patterns having a print coverage of 8%, including a solid image of a square of 2.5 cm each side, were printed on 18 inch×11 inch continuous paper "HSP Sheet G" commercially available from Infoprint Solutions, high-quality paper for Infoprint 4000, 18 inch×11 inch (continuous amount: 55 kg), Bekk smoothness: 82 S, calcium carbonate content: 4% by mass) and rolled sheets having a width of 18 inch "Domtar 20# Paper" commercially available from Domtar, multi-purpose papers, Bekk smoothness: 32S, calcium carbonate content: 13% by mass)" under ambient temperature, ambient humidity conditions of 24° C. and 50% for 10,000 sheets. The photoconductor surface after printing 10,000 sheets was photographed at 10 points, and the area of the deposits on the photoconductor surface was measured by imaging processing. An average of the proportion occupied by the deposits on the photoconductor surface at this time is defined as a photoconductor soiling area. The smaller the value, the more inhibited the photoconductor soiling.

Here, the judgment of the deposits was conducted as follows.

The deposits of the photoconductor surface obtained in Test Example 1 were analyzed by FT-IR, Fourier Transformer Infrared Spectrophotometric Analyzer.

The blade of a cutter was contacted with the surface of "Domtar 20# paper" commercially available from Domtar, multi-purpose paper, Bekk smoothness: 32 S, calcium carbonate content: 13% by mass, and the paper powders were scraped off in a necessary amount. The amount 0.2 mg of the paper powders, 1.8 mg of a toner and KBR, potassium bromide, were sufficiently triturated while mixing in a mortar, and a peak intensity was measured according to the FT-IR method using a mixture composed of a toner and paper powders in a mixing ratio of 9:1 as a standard sample. Similarly, a peak intensity of each ratio of a mixture composed of a toner and paper powders in a ratio of from 10:0 to 0:10 was measured, and a ratio of a peak intensity ascribed to paper powders to a peak intensity ascribed to a toner, i.e. a peak intensity ascribed to paper powders/a peak intensity ascribed to a toner was calculated. The ratio of peak intensities obtained from these standard samples and the ratio of the peak intensities of the deposits of the photoconductor were compared, and a case where a ratio of a peak intensity ascribed to paper powders to a peak intensity ascribed to a toner in the photoconductor deposits falls within a mixing ratio of from 0:10 to 3:7 in the standard samples was judged as deposits ascribed to the paper powders.

Here, the definition of the peak intensities mentioned above will be explained in detail referring to the drawing.

FIG. 1 is a chart showing one example of FT-IR spectrum of a mixture of a toner and paper powders. A tangent line drawn from a peak top A to a peak top B is defined as a baseline, wherein the peak top A is at a wavenumber ranging from 1,000 $cm^{-1}$ to 650 $cm^{-1}$, and wherein a peak top B is at a wavelength ranging from 2,000 $cm^{-1}$ to 1,700 $cm^{-1}$ in the X-coordinates. In addition, in the FIGURE, a line perpendicular to the X-coordinates is drawn from a peak bottom C at a wavenumber ranging from 1,750 $cm^{-1}$ to 1,700 $cm^{-1}$ in the X-coordinates, of which CO stretching oscillations are ascribed to an ester compound. A peak height obtained by subtracting the value of absorbance at an intersection of the above perpendicular line and the above baseline from the value of a peak height of the absorbance of the above peak bottom C is defined as a peak intensity of the toner. Similarly, a line perpendicular to the X-coordinates is drawn from a peak bottom D at a wavenumber ranging from 1500 $cm^{-1}$ to 1400 $cm^{-1}$, CH bending oscillations ascribed to cellulose, in the X-coordinates. A peak height obtained by subtracting the value of absorbance at an intersection of the above perpendicular line and the above baseline from the value of a peak height of the absorbance of the above peak bottom D is defined as a peak intensity of the paper powders. Here, the peak C ascribed to the toner and the peak D ascribed to the paper powders differ depending upon the toners and paper powders used, so that an optimal peak that can judge the derivations of the toner and the paper powder can be selected.

The peak intensity ratio of the standard samples obtained by the above definition, in which the peak intensity ratios, i.e. the peak intensity ratio=peak ascribed to paper powders/peak ascribed to toner, were as follows:

toner:paper powder mixing ratio 10:0=0.6
toner:paper powder mixing ratio 9:1=1.5
toner:paper powder mixing ratio 8:2=2.4
toner:paper powder mixing ratio 7:3=3.4
toner:paper powder mixing ratio 6:4=4.3
toner:paper powder mixing ratio 5:5=5.3
toner:paper powder mixing ratio 4:6=6.4
toner:paper powder mixing ratio 3:7=7.4
toner:paper powder mixing ratio 2:8=8.3
toner:paper powder mixing ratio 1:9=9.5
toner:paper powder mixing ratio 0:10=10.6

Test Example 2

Smearing Resistance, Rubbing Fusing Ability

A two-component developer was loaded on a contact development developer device "Infoprint 4000IS1" commercially available from Ricoh, linear speed: 1,066 mm/sec, resolution: 240 dpi, development system: three magnetic rollers, selenic photoconductor, reversal development. Print patterns having a print coverage of 8%, including a solid image of a square of 2.5 cm each side, were printed on 18 inch×11 inch continuous paper "HSP Sheet G" commercially available from Infoprint Solutions, high-quality paper for Infoprint 4000, 18 inch×11 inch (continuous amount: 55 kg), Bekk smoothness: 82 S, calcium carbonate content: 4% by mass) under ambient temperature, ambient humidity conditions of 24° C. and 50% for 3,000 sheets. The printout sheet of 3,000th sheet obtained was set on a rubbing tester equipped with a metal blade. Blank sheet "HSP sheet G" was wound around a contact side with the printout sheet, and rubbed over the solid image portion with a metal blade to which a 3 kg load was applied, for 20 reciprocations. The degree of whiteness of the blank sheet before and after rubbing was measured with "Gretag SPM50" commercially available from GretagMacbeth, absolute white calibration; Pol filter, observed scope: 2°, illumination type: +, Wbase; Abs, Dstd; DIN NB; Sample mode, and a difference thereof (degree of whiteness of blank sheet after rubbing—degree of whiteness of blank sheet after rubbing) was calculated as an index for fusing strength. The smaller the value, the more excellent the rubbing fusing ability.

TABLE 1

| | Resin Binder, Parts by Mass | | Amount of Fine Fluororesin Particles Based on 100 Parts by Mass of Resin Binder in Toner Raw Material | Recycled | Amount of Fine Fluororesin Particles in | Amount of Fine Fluororesin Particles in Recycled Powder Based on 100 Parts by Mass of Fine Fluororesin Particles in Toner Raw Material | Photoconductor Soiling | | | |
|---|---|---|---|---|---|---|---|---|---|---|
| | | | | | | | Domtar Papers | | HSP | |
| | Resin A | Resin B | Composition, Parts by Mass | Powder, Parts by Mass | Recycled Powder, Parts by Mass | Composition, Parts by Mass | Ratio of Peak Intensities* | Area | Sheets Area | Smearing Resistance |
| Ex. 1 | 100 | — | 2 | 15 | 0.27 | 13.5 | 7.8 | 0.1 | 0 | 2.1 |
| Ex. 2 | 100 | — | 2 | 10 | 0.18 | 9.0 | 8.3 | 0.3 | 0 | 2.8 |
| Ex. 3 | 100 | — | 2 | 5 | 0.09 | 4.5 | 8.6 | 0.8 | 0 | 3.3 |
| Ex. 4 | 100 | — | 2 | 3 | 0.05 | 2.5 | 8.5 | 0.8 | 0 | 3.3 |
| Ex. 5 | 100 | — | 2 | 2 | 0.04 | 2.0 | 8.5 | 0.9 | 0 | 3.2 |
| Ex. 6 | 100 | — | 2 | 20 | 0.35 | 17.5 | 7.8 | 0.1 | 0 | 2.0 |
| Ex. 7 | 100 | — | 2 | 25 | 0.44 | 22.0 | 8.0 | 0.1 | 0 | 2.1 |
| Ex. 8 | 100 | — | 2 | 30 | 0.53 | 26.5 | 7.9 | 0.1 | 0 | 2.0 |
| Ex. 9 | 100 | — | 1.5 | 15 | 0.20 | 13.3 | 7.9 | 0.1 | 0 | 7.8 |
| Ex. 10 | 100 | — | 1 | 15 | 0.13 | 13.0 | 7.8 | 0.1 | 0 | 13.6 |
| Ex. 11 | 100 | — | 0.5 | 15 | 0.07 | 14.0 | 8.4 | 0.9 | 0 | 18.5 |
| Ex. 12 | 100 | — | 3 | 15 | 0.40 | 13.3 | 8.4 | 0.5 | 0 | 1.9 |
| Ex. 13 | 100 | — | 4 | 15 | 0.53 | 13.3 | 8.7 | 0.9 | 0 | 1.7 |
| Ex. 14 | 90 | 10 | 2 | 15 | 0.27 | 13.5 | 8.2 | 0.3 | 0 | 2.5 |
| Ex. 15 | 80 | 20 | 2 | 15 | 0.27 | 13.5 | 8.2 | 0.6 | 0 | 2.6 |
| Ex. 16 | 70 | 30 | 2 | 15 | 0.27 | 13.5 | 8.8 | 1.6 | 0 | 3.1 |
| Comp. Ex. 1 | 100 | — | 2 | 0 | 0 | 0 | 9.5 | 5.3 | 0 | 3.8 |
| Comp. Ex. 2 | 100 | — | 0 | 0 | 0 | — | 8.9 | 1.5 | 0 | 23.5 |
| Comp. Ex. 3 | 100 | — | 2 | 1 | 0.02 | 1.0 | 9.1 | 2.6 | 0 | 3.3 |
| Comp. Ex. 4 | 100 | — | 5 | 15 | 0.66 | 13.2 | 9.3 | 2.3 | 0 | 1.7 |
| Comp. Ex. 5 | 100 | — | 0 | 15 | 0 | — | 9.1 | 1.6 | 0 | 23.3 |
| Comp. Ex. 6 | 100 | — | TG820F = 2 | 15 | — | — | 9.0 | 1.5 | 0 | 22.8 |

*Ratio of intensities of peak ascribed to the paper powders to peak ascribed to the toner according to FT-IR method, i.e. peak ascribed to the paper powders/peak ascribed to the toner, and in a case of usual filming, filming derived from the toner, a ratio of intensities being 2.0 or so.

It can be seen from the above results that the toners of Examples 1 to 16 have excellent inhibition of photoconductor soiling due to paper powders even in all-purpose papers, and the toners are excellent in smearing resistance, whereas the toners of Comparative Examples 1 to 6 would cause photoconductor soiling in lower quality all-purpose sheets, while not causing photoconductor soiling when high-quality sheets were used.

The positively chargeable toner obtainable by the method of the present invention is suitably used in developing latent images formed in, for example, an electrophotographic method, an electrostatic recording method, an electrostatic printing method, or the like.

What is claimed is:

1. A method for producing a positively chargeable toner, the method comprising:

melt-kneading a toner raw material composition comprising a resin binder, a positively chargeable charge control agent, and fine fluororesin particles, and a recycled powder, thereby obtaining a melt-kneaded mixture;

cooling the melt-kneaded mixture obtained in the melt kneading, and pulverizing a cooled mixture, thereby obtaining a pulverized product; and classifying the pulverized product obtained in the cooling and pulverizing, wherein the recycled powder is a powder removed in the classifying, wherein the amount of the recycled powder melt-kneaded with the toner raw material composition in the melt-kneading is 1.5 parts by mass or more, based on 100 parts by mass of the resin binder in the toner raw material composition, and wherein the resin binder in the toner raw material composition comprises 50% by mass or more of a polyester having a softening point of 125° C. or higher and 170° C. or lower, wherein the content of the fine fluororesin particles in the toner raw material composition in the melt-kneading is 0.3 parts by mass or more and 4.5 parts by mass or less, based on 100 parts by mass of the resin binder in the toner raw material composition, and wherein a content of the fine fluororesin particles in the recycled powder in the melt-kneading is from 1.5 parts to 50 parts, based on 100 parts by mass of the fine fluororesin particles in the toner raw material composition.

2. The method for producing a positively chargeable toner according to claim 1, further comprising mixing a classified product obtained in the classifying with an external additive.

3. The method for producing a positively chargeable toner according to claim 1, wherein the content of the fine fluororesin particles in the toner obtained in the classifying is 1 part by mass or more and 4 parts by mass or less, based on 100 parts by mass of the resin binder in the toner raw material composition in the melt-kneading.

4. The method for producing a positively chargeable toner according to claim 1, wherein the positively chargeable charge control agent comprises a Nigrosine dye.

5. The method for producing a positively chargeable toner according to claim 4, wherein the positively chargeable charge control agent further comprises a quaternary ammonium salt compound.

6. The method for producing a positively chargeable toner according to claim 1, wherein the recycled powder has a volume-median particle size of 5 μm or less.

7. The method for producing a positively chargeable toner according to claim 1, wherein the toner obtained in the classifying has a volume-median particle size of from 6 to 15 μm.

8. The method for producing a positively chargeable toner according to claim 1, wherein the fine fluororesin particles are made of a polytetrafluoroethylene.

9. The method for producing a positively chargeable toner according to claim 1, wherein the fine fluororesin particles have a number-average particle size of 100 nm or more and 1 μm or less.

10. The method for producing a positively chargeable toner according to claim 1, wherein an alcohol component of the polyester having a softening point of 125° C. or higher and 170° C. or lower comprises an alkylene oxide adduct of bisphenol A represented by the formula (I):

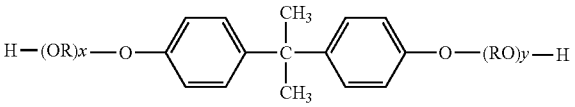

wherein RO and OR are an oxyalkylene group, wherein R is an ethylene and/or propylene group, x and y each shows an average number of moles of the alkylene oxide added, each being a positive number, and the sum of x and y on average is 1 or more and 16 or less.

11. The method for producing a positively chargeable toner according to claim 10, wherein the content of the alkylene oxide adduct of bisphenol A represented by the formula (I) is 50% by mol or more of the alcohol component.

12. The method for producing a positively chargeable toner according to claim 1, wherein a carboxylic component of the polyester having a softening point of 125° C. or higher and 170° C. or lower comprises at least one member selected from the group consisting of fumaric acid, terephthalic acid, dodecenylsuccinic acid, and acid anhydrides thereof.

13. The method for producing a positively chargeable toner according to claim 12, wherein the content of at least one member selected from the group consisting of fumaric acid, terephthalic acid, dodecenylsuccinic acid, and acid anhydrides thereof is 50% by mol or more of a total content of dicarboxylic acid in the polyester.

14. The method for producing a positively chargeable toner according to claim 1, wherein the melt-kneading is carried out with a twin-screw kneader.

15. The method for producing a positively chargeable toner according to claim 2, wherein the external additive is a hydrophobic silica that is hydrophobically treated.

16. A positively chargeable toner obtained by the method of claim 1.

17. A method for forming fused images, comprising:

charging a photoconductor;

exposing the photoconductor;

developing comprising adhering the positively chargeable toner of claim 16 to an electrostatic latent image formed on the photoconductor, to form a visible image;

transferring a formed visible image to a printout sheet; and fusing a transferred visible image to the printout sheet, wherein the printout sheet has a Bekk smoothness of 60 seconds or less.

18. The method for forming fused images according to claim 17, wherein the content of calcium carbonate of the printout sheets is 8% by mass or more and 20% by mass or less.

* * * * *